US007650680B2

(12) United States Patent
Stillings et al.

(10) Patent No.: US 7,650,680 B2
(45) Date of Patent: Jan. 26, 2010

(54) METHOD AND APPARATUS FOR BUNDLING OBJECTS

(75) Inventors: Matthew J. Stillings, Centennial, CO (US); Daniel J. Nelson, Denver, CO (US); Miklos B. Marelin, Aurora, CO (US); Ryan M. Stoltz, Denver, CO (US)

(73) Assignee: Band-It-Idex, Inc., Denver, CO (US)

( * ) Notice: Subject to any disclaimer, the term of this patent is extended or adjusted under 35 U.S.C. 154(b) by 469 days.

(21) Appl. No.: 11/253,101

(22) Filed: Oct. 17, 2005

(65) Prior Publication Data

US 2007/0084022 A1 Apr. 19, 2007

(51) Int. Cl.
*B21D 39/00* (2006.01)
*F16L 33/00* (2006.01)

(52) U.S. Cl. ..... 29/521; 24/20 R

(58) Field of Classification Search ..... 29/521, 29/428; 24/20 R, 23 W

See application file for complete search history.

(56) References Cited

U.S. PATENT DOCUMENTS

| | | | |
|---|---|---|---|
| 356,083 | A | 1/1887 | Schrader et al. |
| 359,686 | A | 3/1887 | Noyes |
| 997,186 | A | 7/1911 | Flora |
| 1,000,083 | A | 8/1911 | Flora |
| RE14,762 | E | 11/1919 | Springer |
| 1,330,705 | A | 2/1920 | Herrick |
| 1,482,247 | A | 1/1924 | Nowland |
| 1,555,819 | A | 10/1925 | Baruch |
| 1,565,865 | A | 12/1925 | Ragona |
| 1,600,833 | A | 9/1926 | McChesney |
| 1,649,363 | A | 11/1927 | Parsons |
| 1,670,201 | A | 5/1928 | McGary |
| 1,712,037 | A | 5/1929 | Halter |
| 1,849,784 | A | 3/1932 | Birch et al. |
| 1,887,732 | A | 11/1932 | Pagel et al. |
| 1,948,719 | A | 2/1934 | King |

(Continued)

FOREIGN PATENT DOCUMENTS

| | | |
|---|---|---|
| CA | 658135 | 2/1963 |

(Continued)

OTHER PUBLICATIONS

European Search for Application No. EP 06 255 334.2, mailed Feb. 6, 2008.

(Continued)

*Primary Examiner*—John C Hong
(74) *Attorney, Agent, or Firm*—Sheridan Ross P.C.

(57) ABSTRACT

An improved tool for locking a band clamp, and an improved lock for a band clamp is disclosed. The tool includes a knife body having a knife edge that progressively cuts the free end of the band over a period of time, rather than simultaneously cutting the entire band width. In one embodiment, this is accomplished with a knife edge that is non-linear. The tool further includes a punch with a rounded or hemispherical shaped leading tip that forms an improved locking dimple. The locking dimple forms an improved lock having side walls that are, at least in part, parallel with the walls of the surrounding aperture in the band. By varying the profile of the knife edge, the punch can more fully form an improved locking dimple.

40 Claims, 11 Drawing Sheets

U.S. PATENT DOCUMENTS

| | | | |
|---|---|---|---|
| 1,973,823 | A | 9/1934 | Monten |
| 1,989,669 | A | 2/1935 | Harvey |
| 1,990,820 | A | 2/1935 | Flader |
| 2,007,002 | A | 7/1935 | Porter |
| 2,075,720 | A | 3/1937 | Hoffmann |
| 2,087,655 | A | 7/1937 | Prestwich |
| 2,115,736 | A | 5/1938 | McAneny |
| 2,118,158 | A | 5/1938 | Ott |
| 2,192,979 | A | 3/1940 | McAneny, Jr. |
| 2,208,114 | A | 7/1940 | Campbell |
| 2,208,134 | A | 7/1940 | McAneny |
| 2,210,510 | A | 8/1940 | Sutton |
| 2,214,110 | A | 9/1940 | Ott |
| D123,270 | S | 10/1940 | Mahn |
| 2,312,400 | A | 3/1943 | Govanus |
| 2,318,946 | A | 5/1943 | Kass |
| 2,324,609 | A | 7/1943 | Watt et al. |
| 2,349,608 | A | 5/1944 | Bramble |
| 2,536,536 | A | 1/1951 | Childress et al. |
| 2,643,687 | A | 6/1953 | Schlage et al. |
| 2,837,494 | A | 6/1958 | Gilbert et al. |
| 2,870,503 | A | 1/1959 | McAneny |
| 2,871,738 | A | 2/1959 | Abbiati |
| 2,882,934 | A | 4/1959 | Gerrard |
| 2,928,434 | A | 3/1960 | McAneny |
| 2,967,550 | A | 1/1961 | Rosenberger et al. |
| 2,998,629 | A | 9/1961 | Smith |
| 3,015,865 | A | 1/1962 | Rapuzzi |
| 3,061,302 | A | 10/1962 | Dennis |
| 3,067,640 | A | 12/1962 | Lodholm |
| 3,152,621 | A | 10/1964 | Meier |
| 3,241,579 | A | 3/1966 | Partridge |
| 3,261,062 | A | 7/1966 | Scarborough, Jr. |
| 3,344,815 | A | 10/1967 | Lawson et al. |
| 3,552,450 | A | 1/1971 | Plunkett |
| 3,596,686 | A | 8/1971 | Blumenfeld et al. |
| 3,610,296 | A | 10/1971 | Kabel |
| 3,660,869 | A | 5/1972 | Caveney et al. |
| 3,735,784 | A | 5/1973 | Obuch et al. |
| 3,748,697 | A | 7/1973 | Marchese et al. |
| 3,782,426 | A | 1/1974 | Morgan et al. |
| 3,833,969 | A | 9/1974 | Hollingsworth et al. |
| 3,837,211 | A | 9/1974 | Gress et al. |
| 3,964,133 | A | 6/1976 | Wasserlien, Jr. |
| 4,015,311 | A | 4/1977 | Curtis |
| 4,041,993 | A | 8/1977 | Angarola |
| 4,047,545 | A | 9/1977 | Paradis |
| 4,056,128 | A | 11/1977 | Konrad |
| 4,272,870 | A | 6/1981 | McCormick |
| 4,333,210 | A | 6/1982 | Burnett |
| 4,390,047 | A | 6/1983 | Kaneko |
| 4,418,448 | A | 12/1983 | Sauer |
| 4,473,925 | A | 10/1984 | Jansen |
| 4,570,340 | A | 2/1986 | Shaw |
| 4,607,867 | A | 8/1986 | Jansen |
| 4,646,393 | A | 3/1987 | Young |
| 4,646,591 | A | 3/1987 | Jansen |
| 4,696,327 | A | 9/1987 | Wolcott |
| 4,726,403 | A | 2/1988 | Young et al. |
| 4,733,701 | A | 3/1988 | Loisel et al. |
| 4,747,433 | A | 5/1988 | Dixon |
| 4,765,032 | A | 8/1988 | Fortsch |
| 4,793,385 | A | 12/1988 | Dyer et al. |
| 4,887,334 | A | 12/1989 | Jansen et al. |
| 4,896,402 | A | 1/1990 | Jansen et al. |
| 4,928,738 | A | 5/1990 | Marelin et al. |
| 4,934,416 | A | 6/1990 | Tonkiss |
| 4,947,901 | A | 8/1990 | Rancour et al. |
| 4,997,011 | A | 3/1991 | Dyer et al. |
| 5,000,232 | A | 3/1991 | Wolcott |
| 5,007,465 | A | 4/1991 | Tonkiss |
| 5,123,456 | A | 6/1992 | Jansen |
| 5,127,446 | A | 7/1992 | Marelin |
| 5,129,350 | A | 7/1992 | Marelin |
| 5,146,847 | A | 9/1992 | Lyon et al. |
| 5,163,482 | A | 11/1992 | Wolcott |
| 5,303,571 | A | 4/1994 | Quinn et al. |
| 5,322,091 | A | 6/1994 | Marelin |
| 5,452,523 | A | 9/1995 | Jansen |
| 5,483,998 | A | 1/1996 | Marelin et al. |
| 5,488,760 | A | 2/1996 | Jansen |
| 5,566,726 | A | 10/1996 | Marelin |
| 5,628,348 | A | 5/1997 | Scott et al. |
| 5,644,819 | A | 7/1997 | Lyons |
| 5,647,563 | A | 7/1997 | Gantner et al. |
| 5,743,310 | A | 4/1998 | Moran |
| 5,850,674 | A | 12/1998 | Jansen |
| 6,014,792 | A | 1/2000 | Marelin et al. |
| 6,302,157 | B1 | 10/2001 | Deschenes et al. |
| 6,481,467 | B2 | 11/2002 | Czebatul |
| 6,615,879 | B2 | 9/2003 | Kurmis |
| 7,373,695 | B2 | 5/2008 | Caveney et al. |

FOREIGN PATENT DOCUMENTS

| | | |
|---|---|---|
| CH | 594821 | 1/1978 |
| CH | 663995 | 1/1988 |
| DE | 571789 | 2/1933 |
| DE | 1268077 | 2/1962 |
| DE | 2036802 | 2/1971 |
| DE | 2007232 | 9/1971 |
| DE | 2534156 | 2/1977 |
| DE | 2825522 | 12/1979 |
| EP | 0174410 | 3/1986 |
| EP | 0 479 623 A1 | 4/1992 |
| EP | 0479602 | 4/1992 |
| EP | 0 579 432 A1 | 1/1994 |
| EP | 0687528 | 12/1995 |
| EP | 0806349 | 11/1997 |
| EP | 1231140 | 8/2002 |
| FR | 1175067 | 5/1957 |
| GB | 1025811 | 4/1966 |
| GB | 1068993 | 5/1967 |
| NL | 7408399 | 12/1975 |
| WO | 96/27526 | 9/1996 |
| WO | WO 2006/128146 A1 | 11/2006 |

OTHER PUBLICATIONS

"Operators Manual Repair Parts List Automatic S350 Auto Air Tool", Band-it, A Unit of IDEX Corporation, 1999, pp. 1-38.

IDEX Corporation, "Automatic Air Tool S350", p. 15, 2000, Band-It The Clamping Experts, Jul. 2000, pp. 1-4.

"IT9000 Bench Mounted Electric Tool Specifications", Band-It, The Clamping experts, date unknown, pp. 1-8.

"Simple Solution to a Complex Problem: Electro Adapter, Inc. Introduces CBS Calibrated Banding System", Electro Adapter, Inc. pp. 1-4.

"Yesterday, Today and Tomorrow Sunbank Meets the Challenge", Sunbank Electronics, Inc., pp. 1-4.

European Search Report for Application No. EP 06 255 334, mailed Feb. 6, 2008.

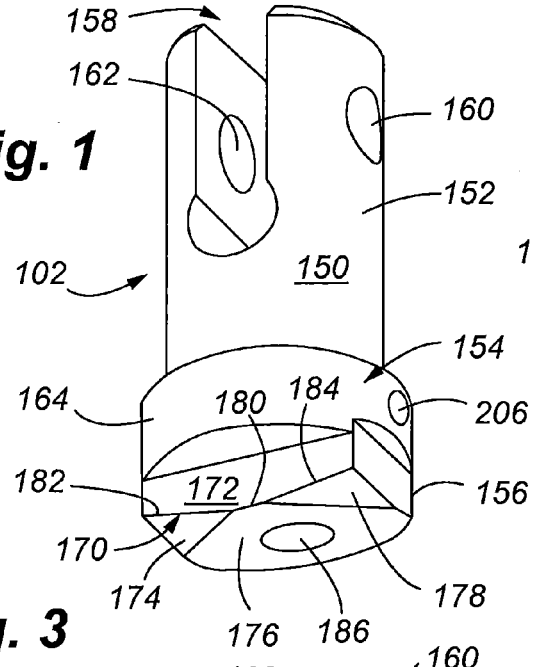
Fig. 1
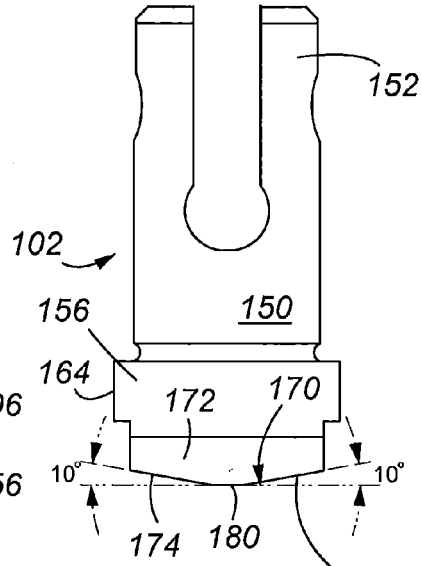
Fig. 2
Fig. 3
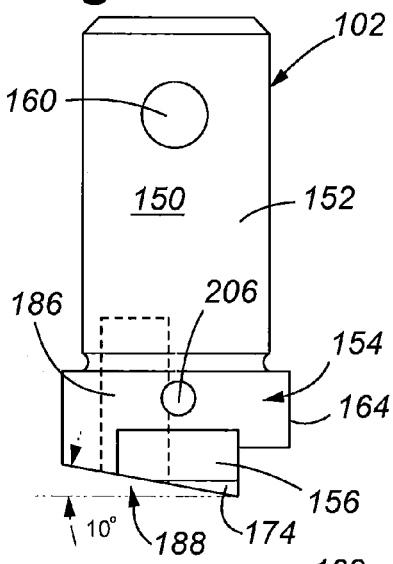
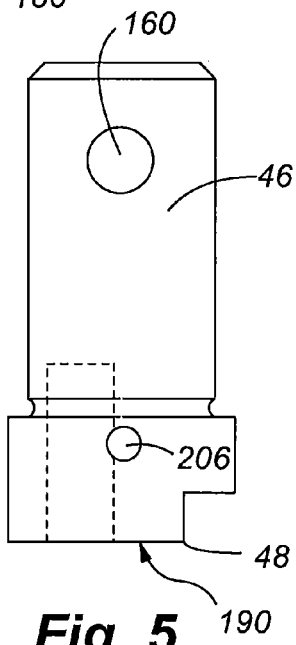
Fig. 5
Prior Art
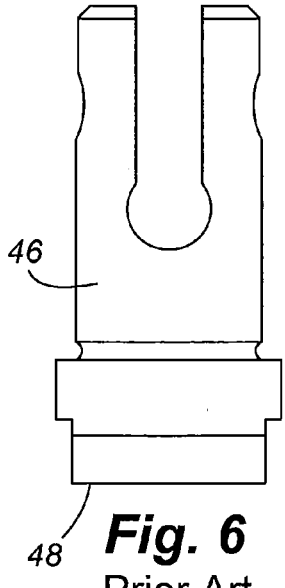
Fig. 6
Prior Art
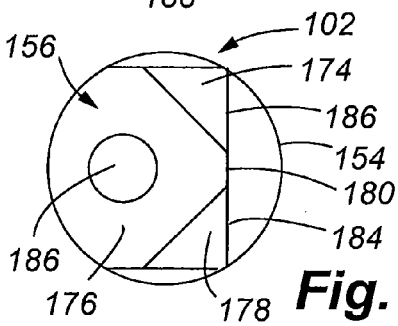
Fig. 4

Fig. 11
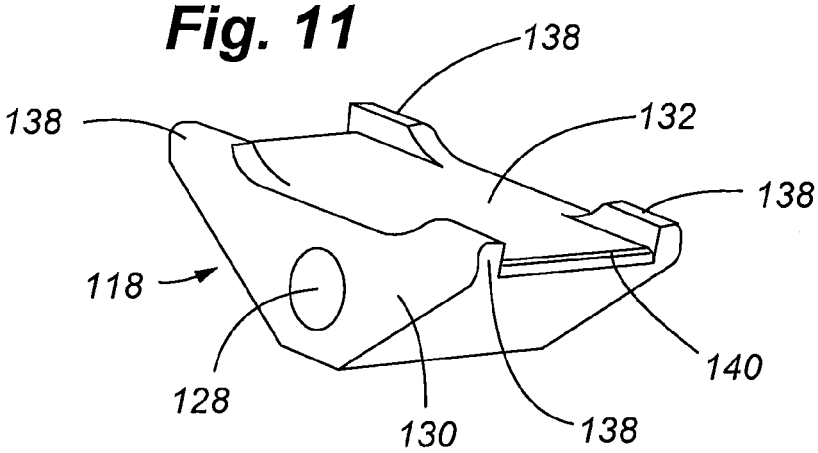
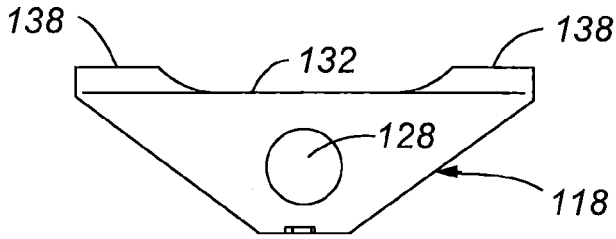
Fig. 12
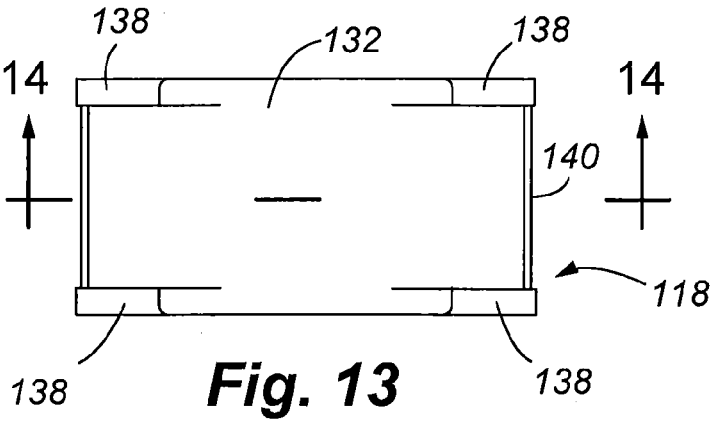
Fig. 13
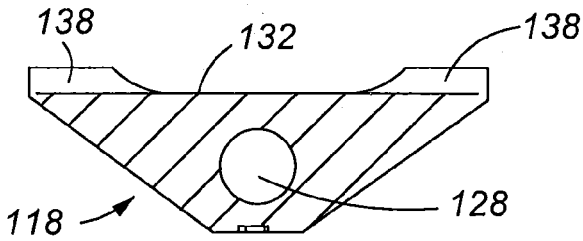
Fig. 14

Fig. 29
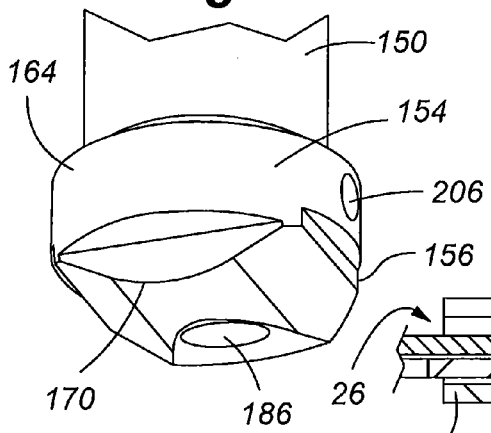
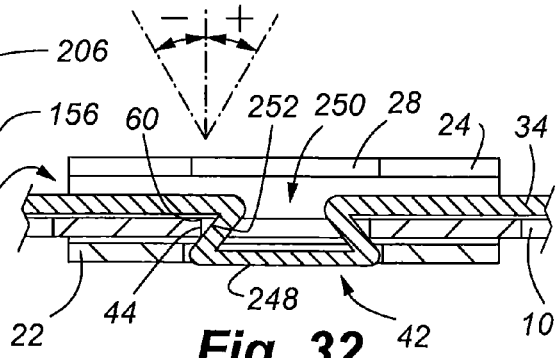
Fig. 32
Fig. 30
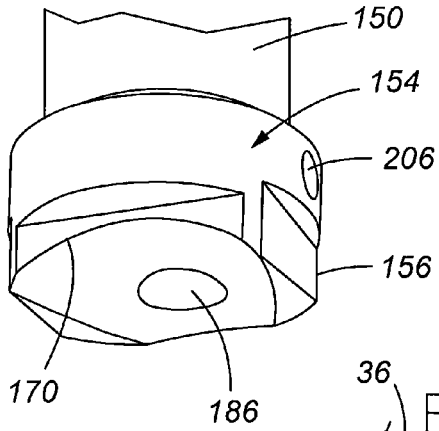
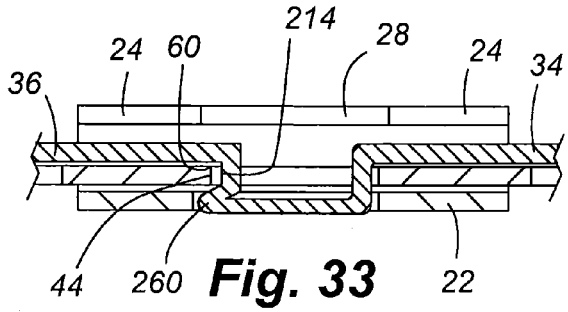
Fig. 33
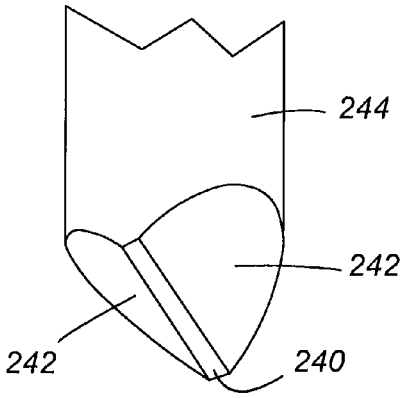
Fig. 31

| Factor | Description | Improved Design | Standard Design |
|---|---|---|---|
| W | Width (in) | 0.375 | 0.375 |
| T | Thickness (in) | 0.02 | 0.02 |
| A | Area (in 2) | 0.0075 | 0.0075 |
| Sy | Yield Strength (psi) | 60,000 | 60,000 |
| Su | Ultimate Strength (lbf) | 115,000 | 115,000 |
| Lts | Loop Tensile Strength | 1,000 | 600 |
| Lf | Equivalent Load in band (.48 * Lts)(lbf) | 480 | 288 |
| Ly | Load in band at Yield (lbf) | | |
| Lu | Load in band at Ultimate Strength (lbf) | 863 | 863 |
| | | | |
| Lf/Lu | Ratio of lock strength to band ultimate strength | 0.5565 | 0.3339 |
| Lf/A | Ratio of lock strength to cross-sectional area of band | 64000 | 38400 |
| Lf/Ly | Ration of lock strength to band yield strength | 1.0667 | 0.6400 |

*Fig. 35*

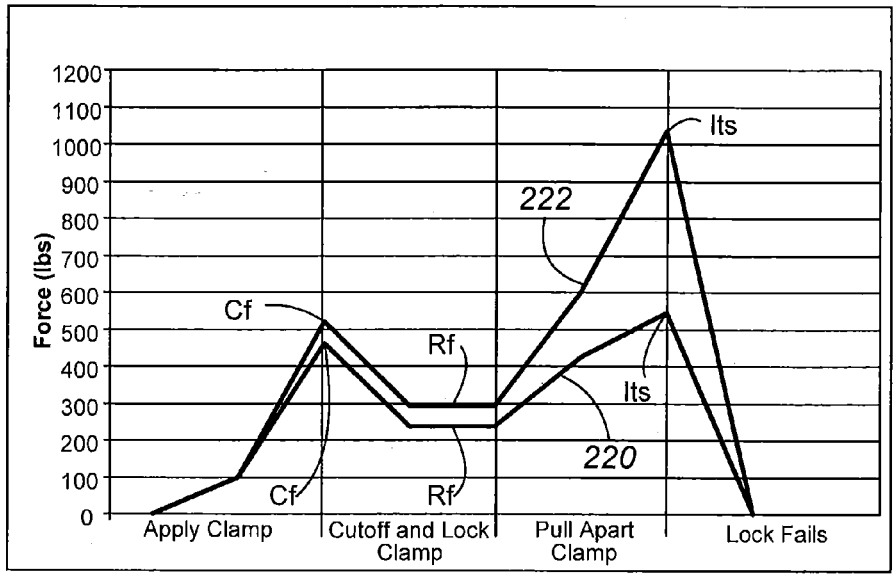

*Fig. 36*

METHOD AND APPARATUS FOR BUNDLING OBJECTS

FIELD OF THE INVENTION

The present invention relates to a method and apparatus for bundling and restraining objects, such as tubing or electrical wires, into a single bundle or for securing covering material or sheeting around objects. In general, the invention relates to securing or locking a band and a buckle of a band clamp. More particularly, the invention relates to an improved lock between the band and a buckle, as well as the method and apparatus for forming the improved lock.

BACKGROUND OF THE INVENTION

Flat band and buckle assemblies, also known as ties, have existed for sometime for use in bundling or securing objects together. Typically, a tie, comprising an elongate band having a free end and a buckle at the opposite end, is wrapped around a group of objects with the free end passed through the buckle. The buckle and overlapping band are secured in some fashion to thereby constrain the group of objects. Similarly, tools for tightening bands around objects, for securing or locking the free end of the band within a buckle or locking member and for cutting any excess portion of the band have existed for some time. Typically, these tools grasp the free end of the band after it has passed through the buckle and apply a force to the free end of the band while simultaneously maintaining the position of the buckle to tighten the band around the group of objects. Once an appropriate tension is applied to the band, the tool will create the desired locking geometry in the band and shear the portion of the free end of the band extending through the buckle. Typically, a pair of opposed knife-edges perform the shearing or cutting operation. One blade is stationary and is positioned beneath the free end of the band and the other knife reciprocates between a first and second position. Each knife-edge comprises a single linear blade or edge that simultaneously engage and simultaneously cut the entire width of the band at once.

Tools that perform the tightening, locking and cutting functions are primarily manual, pneumatic or electric in nature. In the case of pneumatic or electric tools for use in such purposes, the power generated results in these functions being accomplished with limited or reduced physical efforts required by the operator. Band tightening tools that are pneumatic or electric are usually semiautomatic in that the operator of such a tool is required to perform some, but not all, of the tasks or functions associated with providing a band clamp about an object. Manual tasks that remain can include locating the band or tie about the object and inserting or otherwise locating the band clamp relative to the tool so that a tool can perform one or more of its tightening, locking and cutting functions. In one such device, a desired tension can be set for the band clamp about the object. A pneumatic cylinder or similar component is activated to pull the band until the desired band tension is reached. Pneumatic control can also be involved with cutting the free end or band tail portion after the band clamp is tightened, and which can also involve forming a lock that prevents unwanted release of the band clamp.

Current band clamps, however, have significant drawbacks. For example, there is a need for improving loop tensile force (the force required to break the band or separate the lock) other than by simply increasing the physical size of the band. Also, there is a need for improving the percentage of retained force (the residual force in the band after forming the lock). Stated differently, there is a need to reduce or eliminate the force that is lost following formation of the lock and release of the band by the tool. For a number of reasons, including tolerances and imprecise metal forming techniques, once the tool cuts the free end of the band, a portion of the band slips back through the buckle expanding the circumference of the band, a portion of the retained tensile load is lost, and the percent retained force decreases. The lock may also relax or loosen over time, causing the band to expand, particularly if the outward force applied on the band by the constrained objects is large or if the band and buckle are subjected to external forces such as vibration or other motion causing relative motion of the band and buckle. Still further, there is a need in some applications to increase the clamping force (the maximum force reached just prior to the band tightening tool cutting off the excess end of the band). The clamping force is related to the retained force. Typically, the higher the clamping force, the higher the retained force. Unfortunately, there are upper limits to the clamping force in some applications, as the objects being clamped may be damaged if too large a clamping force is applied.

A prior art band clamp is shown in FIGS. 18-20. It consists of a band 10 and a buckle 12. The buckle is secured to a first end 14 of the band, between a retaining dimple 16 and a load dimple 18, generally preventing axial or lateral movement of the buckle relative to the length of the band. In the embodiment shown, the buckle comprises a box-like piece of metal having two side walls 20, a bottom 22, a top 24 and two open ends 26 which permit two layers of the band to pass through the buckle. The top of the buckle 24 has an opening 28 aligned with a similar opening 30 formed in the first end 14 of the band and another opening 32 formed in bottom 22 of the buckle.

A locked band clamp using a prior art tool is illustrated in FIG. 21. As used, the free end 34 of the band is wrapped around one or more objects and inserted into the buckle 12 above the first end of the band 14, thereby creating an overlapping band portion 36. Using a tool of the type generally known to those of skill in the art, the free end 34 of the band is grasped and pulled while the buckle 12 and first end of the band 14 are held stationary by abutting the buckle against a front surface of the tool and positioning the free end of the band clamp over an underlying cutter blade. A punch 38 having a conical shaped tip 40 is then driven through the upper opening 28 and forced into the free end 34 of the band 12 to form a locking dimple 42 in the free end 34 of the band. The locking dimple 42 extends through the opening 30 in the first end of band 14. The aperture 30 defines a two-dimensional area, bounded by surface 44, that defines where the locking dimple 42 may be formed. In general terms, the locking dimple 42 fixes and secures the circumference of the band by abutting the inside surface 44 of the opening 30. The constrained or banded objects place an outward force on the band which, in turn, causes the circumference of the band to expand until locking dimple 42 abuts the inside surface 44 of the aperture 30. The inside surface 44 of the aperture 30 may also be referred to as a load bearing surface.

Simultaneously, a knife 46, as shown in FIGS. 5 and 6, is lowered to cut the free end of the band in conjunction with the underlying cutter blade. The knife 46 includes a single linear blade or cutting edge 48 that extends across the width of the band. The knife-edge engages and cuts the entire band width at once. Therefore, a significant portion of the force driving the tool is applied to cutting the band rather than driving the punch to form the locking dimple. Once the band is cut, the tool no longer holds or constrains the band clamp. Also, there is no further downward travel of the punch, no further formation of the locking dimple and the tool releases its hold of the free end of the band.

The manner in which the locking dimple 42 is formed limits the retained tensile force of the band and contributes to loss of tensile force due to band slip-back. A punch 38 is attached to and extends out in front of the knife 46. Typically, the punch is oriented perpendicular to the band. As the knife 46 travels toward the band, the punch 38 begins formation of the locking dimple 42. When forced against the free end 34 of the band 12, a conical shaped locking dimple 42 is created, as shown in FIG. 21. Moreover, the process of cold forming the locking dimple in combination with the pointed conical tip 40 causes the walls 50 of the locking dimple to be thinner or non-uniform in thickness at the base 52. In addition, and primarily due to manufacturing tolerances, the location of the locking dimple 42 may vary laterally along the band. In particular, the locking dimple 42 may be formed anywhere within the area defined by the inside surface 44 of the opening 30. The lateral or axial distance between the inside surface 44 of the opening and the wall 50 of the locking dimple 42 is shown as $\Delta x_1$ in FIG. 21. As a result, when the free end of the band is cut and the tool releases its grip of the band, the band 12 will laterally release or slip-back at least the distance $\Delta x_1$, as shown by comparing FIG. 21 with FIG. 22. Moreover, additional slip-back may occur, immediately or over time, due to the conical shape of the locking dimple 42 and the relative freedom of movement that the band has in the "Z" direction ($\Delta z$ as shown in FIGS. 21-23). In particular, the space 54 defined between the top 20 and bottom 22 of the buckle 12 is greater than the combined height of the overlapping bands. This space permits the free end 34 of the band to pass through the buckle. The additional height also permits the overlapping bands to move vertically within the interior space 54 of the buckle, as shown in FIG. 22. This additional degree of movement, combined with the sloped outer wall 50 of the locking dimple 42, also allows further slip-back of the band, as illustrated in FIG. 23 as $\Delta x_2$. Thus, even if the locking dimple 42 were initially formed abutting the interior surface 44 of the opening 30 such that there was no $\Delta x_1$, as shown in FIG. 21, lateral slip-back would still occur due to the freedom of movement allowed by the gap $\Delta z$ in combination with the sloped surface 50 of the locking dimple, as shown in FIG. 23. This results in further loss of the retained tension force.

Often, end users specify a retained tensile force for their end use applications, for example, 600 pounds. If the tie being used has a fifty percent loss in retained tensile force following locking and cut off of the free end, then the tie, just prior to locking and cut off, must have a tensile load or clamping force applied to it in the amount of 1,200 pounds to accommodate the fifty percent loss of tensile force. In many situations, the applied or clamping force can exceed the tensile load of the band, causing it to fail. This is more often true when clamping objects having hard surfaces.

Yet the process of forming conical shape of the locking dimple 42 causes another problem. The conical shape of punch tip 40 causes the walls 50 of the locking dimple 42 to be thinned, even to the point that there is no material left in the wall of the dimple, as they are cold formed. The non-uniform or thin portion 52 creates a weak spot that is susceptible to the shear forces acting on the locking dimple 42 by the retained tensile load. The additional height ($\Delta z$) creates a freedom of movement inside the buckle and allows the sloped walls 50 to ride up the edge 60 of the inside surface 44, further opening the band and releasing retained tensile load. The thinned portion 52 will then abut the inside surface 44 of the aperture 30, as shown in FIG. 23. When the retained load is applied against the thinned portion 52 of the walls of the locking dimple, a failure may occur where the edge of the surface 44 shears off the locking dimple or causes the locking dimple to collapse. Thus, the locked band will fail and the bundled objects will be released.

In addition to the foregoing problems, other considerations are relevant in designing a band clamp. First, the clamp should have a high tensile strength to resist the outward tensile force exerted on the clamp by the constrained objects. Second, the clamp should be inexpensive to manufacture. Band clamps are used in a variety of applications where cost is a concern. Thus, simply increasing the physical size of the clamp does not address all of the design considerations. A physically larger band clamp will have a greater loop tensile force, but it will cost more. Also, the band clamp should be simple in design and easy to use.

SUMMARY OF THE INVENTION

The present invention overcomes these problems and provides an improved band clamp and tooling for locking a band clamp. In one embodiment, the apparatus or tool used to deform and lock the band relative to the buckle comprises a movable punch and knife. The profile of the knife-edge, compared to that of the prior art, is improved and causes the application of the dimple forming and cutting force to vary over time. To optimize the formation of a superior locking dimple, it is important to optimize the application of force over time. The varied application of force over time creates an improved locking dimple by initially applying only a portion of the driving force to cut the band. Rather than instantaneously cut the entire band width, the profile of the knife-edge causes a gradual cutting of the band. Also, the profile of the knife-edge may be designed to allow the punch to dwell inside the locking dimple for a longer period of time during the forming process. This causes more material to be moved as part of the cold forming process and reduces spring back of the metal, creating a more fully formed locking dimple. In the preferred embodiment, as shown in FIGS. 1-4, the knife-edge has multiple non-collinear portions and the cutting starts at the center of the band and moves across the width of the band to the lateral edges. Because the entire band width is not cut at the same time, the knife must travel a greater distance to fully cut or sever the band. This additional movement causes the punch to travel further into the band and causes the locking dimple to be more fully and completely formed. A locking dimple that is fully formed with a preferred or optimum shape performs better as a lock. Also, because the knife-edge does not simultaneously cut the entire width of the band, a smaller portion of the driving force is applied over time for cutting the band. This allows a portion of the overall driving force to be applied to forming the locking dimple.

In the preferred embodiment, the knife-edge used to cut and remove the excess portion of the free end of band is not a straight edge. Rather, there are three distinct portions or sections to the knife-edge, for example as shown in FIG. 1. The three edge sections are coplanar, but not collinear. The center section of the knife-edge is parallel to the surface of the band. It forms the leading edge of the knife-edge and impacts the band first. The knife-edge of the preferred embodiment also comprises two lateral portions that extend in opposite directions from the center portion. The lateral knife-edge portions are angled upwardly, relative to the surface of the band, to create an overall tapered or angled edge as shown in FIG. 2. Thus, the entire base of the knife body does not engage the band at one time, as is the case of the prior art knife body shown in FIG. 5, and the knife edge does not engage the entire width of the band simultaneously. Rather, the knife-edge gradually cuts the band outwardly from the center. As a result, more of the downward force can be applied to driving the punch into the band, allowing the punch to dwell, and fully forming the locking dimple. If the free end of the band is cut too quickly, the locking dimple will not form fully and completely. An incompletely formed locking dimple is more susceptible to allowing slip-back and is also susceptible to failure. In addition, the base of the knife is also tapered as shown in FIG. 3. The base or lower portion of the knife body tapers away from the knife-edge and accommodates rotation of the tool and the knife body during tensioning of the band prior to cutting.

Alternative knife-edge profiles could also achieve improved retained tensile force and improved formation of a locking dimple. For example, the knife-edge profile could be concave or convex as shown in FIGS. 28 and 30. The leading edge portion of the knife-edge could start at the outer edge of the band and move inwardly, or start at the center and move outwardly, using a curved edge profile. Instead of being curved, the edge portions could be linear, or a combination of both. In another embodiment, the leading portion of the knife-edge could be positioned at one lateral edge of the knife body rather than the center. An angled or curved edge would adjoin and extend from the lateral knife-edge portion. As a result, one lateral edge of the band would be cut first and the remaining portion of the band would be gradually cut as the angled portion engages the band. Further still, the knife-edge could comprise a single collinear edge that is angled relative to the surface of the band, somewhat like a guillotine. A variety of alternative knife-edge profiles are shown in FIGS. 31A-31L. Each of these alternative knife-edge profiles would require additional travel of the knife body, compared to the prior art knife-edge, to sever the free end of the band. It should be appreciated that changing the angle of the knife-edge will alter the travel of the punch and alter the formation of the locking dimple. The knife-edge profile can be selected to optimize the desired shape of the locking dimple.

Additionally, the shape of the punch tip is improved. In one embodiment, shown in FIGS. 9 and 10, the punch tip is generally hemispherical in shape. This shape forms at least a portion of the side walls of the locking dimple in the shape of a cylinder. It further contributes to making the side walls generally uniformly thick, compared to the prior art design. It also forms at least a portion of the side walls generally parallel to the inside surface of the apertures formed in the band and bottom of the buckle, rather than a wall that is sloped relative to the inside surfaces of these apertures such as in the prior art design. The abutting parallel walls create an improved locking force. As a result, the generally parallel walls reduce or eliminate the slip-back caused by separation of the overlapping band portions, $\Delta z$, inside the buckle. Nonetheless, should the upper band separate from the lower portion of the band within the interior of the buckle, the fact that the locking dimple is more fully, uniformly and deeply formed, and the fact that at least an abutting portion of the outer wall of the locking dimple is substantially parallel to the inside surface of the aperture formed in the band, will cause the locking dimple to maintain a locked relationship of the band clamp beyond that provided by the prior art band clamp. In addition, by switching to a punch tip where the leading portion is rounded, the cold working of the band to form the locking dimple does not thin the walls of the locking dimple to the same extent as the conical shaped punch tip. As a result, the chances of a failure from shearing the locking dimple or dimple collapse is substantially reduced.

An alternative punch design is shown in FIG. 29. Here, the leading edge is not rounded. Rather, the leading portion generally comprises two beveled surfaces, but the main body portion remains cylindrical. The cylindrical shape of the main body forms a locking dimple having a side wall that is substantially parallel to the inside wall of the aperture formed in the band. Thinning of the walls of the locking dimple will be avoided by employing proper profiling of the application of force by the punch. A controlled rate of drawing, such as by varying the force applied by the punch over time, as illustrated by FIG. 27, will maintain a more uniform wall thickness in the locking dimple during the drawing process. A further alternative, shown in FIG. 31, is to form a locking dimple with an abutting wall portion formed at an angle opposite that of the prior art, such as is illustrated in FIGS. 21-23. In the alternative embodiment, the angle of the side wall of the locking dimple promotes locking and retained tensile load. A further alternative would be to form a toe or protrusion in the base of the locking dimple on the load bearing side to capture the band. This arrangement is illustrated in FIG. 32.

In one embodiment, the apparatus and method of the present invention also forms the locking dimple at a position closely adjacent the inner surface of the aperture in the band (FIG. 24). This is accomplished by driving the punch into the band at an angle relative to the inner surface of the aperture formed in the underlying band. By doing so, a substantial portion of the slip-back, $\Delta x$, in the band is substantially reduced or completely eliminated. The ability to position the punch at an angle relative to the overlapping band portions may be further facilitated by angling the base portion of the knife body so that it does not contact the band all at once, and altering the travel of the knife body to reciprocate at an angle relative to the overlapping band portions.

In operation, in one embodiment, during a first period of time, the punch and knife move toward the overlapping bands together. During a second period of time, the punch first contacts the upper portion of the band and initially forms a locking dimple by driving the upper band through the opening in the lower band and into the opening in the bottom of the buckle. Shortly thereafter, during a third period of time, the center section of the knife-edge engages a center portion of the band and begins the cutting action. At this point in time, the punch will dwell inside the locking dimple, until the knife-edge overcomes the resistance of the metal band and begins its cutting action. Because only a portion of the cutting edge has engaged the band and because the lateral portions of the knife-edge are angled away from the center portion, further downward travel of the knife-edge is required to fully cut the band. As the knife edge is driven into the band, gradually the tapered lateral portions of the knife engage the band during a fourth period of time, further cutting it. This, in turn, causes the punch to travel further into the upper band portion and form a deeper and more complete or fully formed locking dimple.

By altering the knife-edge profile an improved locking dimple is formed. The formation of an improved locking dimple improves retained tensile force by reducing losses attributed to slip back of the band and failure of the locking dimple. By improving retained tensile force, a given band can accommodate a greater tensile load, achieving a greater loop tensile strength, without needing to be subjected to a greater clamping force applied at the time of locking and band cut off. The preferred embodiment of the present invention provides an increase of approximately sixty-seven percent in the ratio of lock strength to ultimate band strength, the ratio of lock strength to cross-sectional area of the band and in the ratio of lock strength to band yield strength, regardless of the physical dimension or properties of the band. Nevertheless, it will be appreciated by those of ordinary skill in the art that a ten percent increase in these normalized characteristics represents a substantive improvement over existing ties as it presents an order of magnitude improvement. Thus, a ten percent improvement is within the scope of the invention and can be obtained by practicing the principles embodied herein in a less precise or controlled manner.

In better understanding the present invention, the following definition may be of assistance. Loop tensile strength is the amount of load required to pull apart two halves of a split mandrel after a tie has been clamped around the mandrel. Equivalent load in the band is the loop tensile strength multiplied by a constant (0.48), which accounts for friction. Setting aside friction, the constant is 0.50. Yield is the plastic or permanent deformation of a material. Therefore, load in the band at yield is measured at the time yielding in the band begins to occur. Similarly, load in the band at ultimate or maximum strength is measured at the moment the band breaks.

BRIEF DESCRIPTION OF THE DRAWINGS

FIG. 1 is a perspective view of one embodiment of a knife body of the present invention.

FIG. 2 is a plan view of the knife body of FIG. 1.

FIG. 3 is a side elevation view of a knife body of FIG. 1.

FIG. 4 is a bottom plan view of the knife body of FIG. 1.

FIG. 5 is a side elevation view of a prior art knife body.

FIG. 6 is a front plan view of the prior art knife body of FIG. 5.

FIG. 11 is a perspective view of one embodiment of a cutter blade of the present invention.

FIG. 12 is a side elevation view of the cutter blade of FIG. 11.

FIG. 13 is a top plan view of the cutter blade of FIG. 11.

FIG. 14 is a cross-sectional view of the cutter blade of FIG. 13 taken along line 14-14 of FIG. 13.

FIG. 29 is a perspective view of a first alternative embodiment of a knife body of the present invention.

FIG. 30 is a perspective view of a second alternative embodiment of a knife body of the present invention.

FIG. 31 is a perspective view of a first alternative embodiment of the punch of the present invention.

FIG. 32 is a partial cross-section view of a locked band clamp, further showing a first alternative embodiment of a locking dimple of the present invention.

FIG. 33 is a partial cross-section view of a locked band clamp, further showing a second alternative embodiment of a locking dimple of the present invention.

FIG. 35 is a table showing normalized characteristics of the present invention.

FIG. 36 is a graph of the mean value forces of a conventional tie, compared to a tie incorporating aspects of the present invention.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 7:
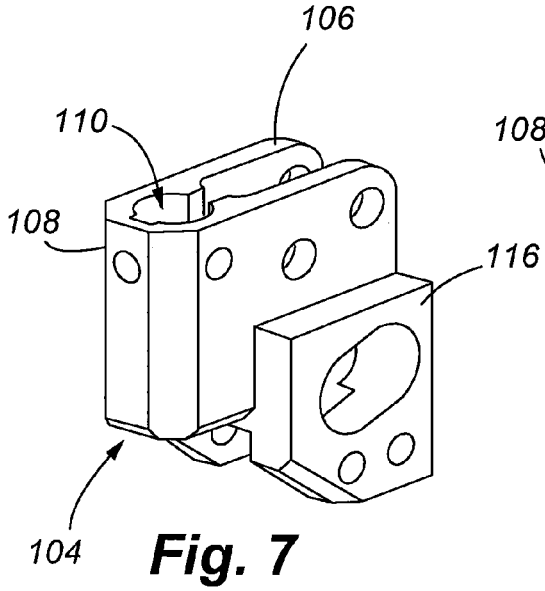
FIG. 7 is a perspective view of one embodiment of a tool head of the present invention.
Figure 8:
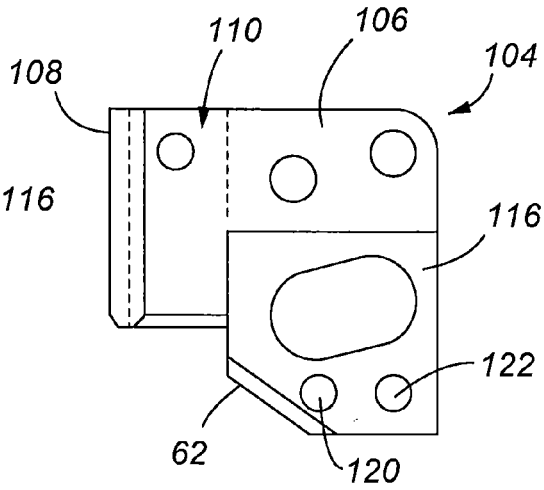
FIG. 8 is a side elevation of the tool head of FIG. 7.
Figure 9:
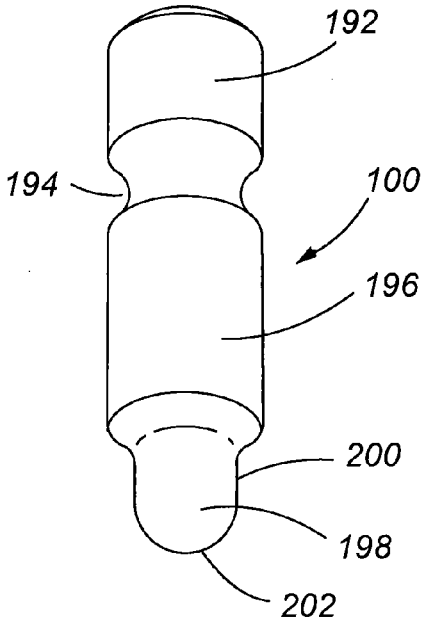
FIG. 9 is a perspective view of one embodiment of the punch of the present invention.
Figure 10:
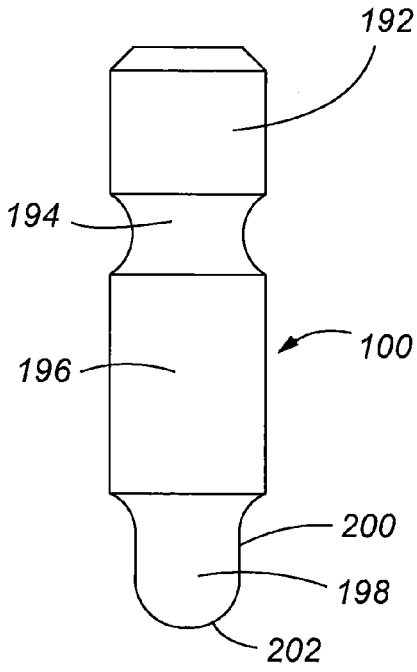
FIG. 10 is a front elevation view of the punch of FIG. 9.

Referring to FIGS. 1 and 9, one embodiment of an improved punch and knife for use in a banding system, such as the Band-It ⅜" Tie-Lok® system manufactured and sold by the Assignee of the present invention, is shown. In use, both the punch 100 and the knife 102 are positioned in a tool head 104. The tool head 104, shown in FIGS. 8 and 9, is stationary and the knife and punch move along a linear path between an upper position and a lower position. The tool head 104 comprises a body 106 having a first portion 108 with a cylindrical shaft or bore 110 for holding the knife 102 and guiding its reciprocating movement. The tool head has a second portion 116 in which a stationary cutter blade 118 is secured. The second body portion 116 includes a pair of apertures 120, 122 through which pins 124, 126 are positioned to secure the cutter blade 118. The cutter blade 118 includes a bore 128 to receive one of the pins.

A preferred embodiment of the cutter blade 118 is shown in FIGS. 11-14. The cutter blade 116 is generally triangular in cross-section, having a main body 130 containing the bore 128. The cutter blade 118 has a relatively flat upper surface 132 shaped to receive the free end 134 of a band 136. Four raised portions 138 extend above the flat portion 132 to guide the free end of the band. The dimensions of the upper surface 132 and raised portions 138 can vary to accommodate bands of different widths and thicknesses. A cutting edge 140 is formed at the leading edge of the cutter blade 118.

In operation, the tool head 104 and the cutter blade 118 are stationary. The knife 102 and punch 100 reciprocate within the bore 110. In its uppermost position (FIG. 15), when the knife 102 is furthest from the cutter blade 118, the free end 134 of the band 136 will pass through the second portion 116 of the tool head 104 and engage a tensioning mechanism of the tool (not shown). Persons of skill in the art know such tensioning mechanisms. In its lowest position (FIG. 17), the knife 102 and cutter edge 140 cooperate to cut the free end 134 of the band.

Referring now to FIGS. 1-4, the knife 102 is shown in greater detail. The knife 102 comprises a main body 150 having a first cylindrical portion 152, a second cylindrical portion 154 having a larger diameter than the first cylindrical portion 152, and a base portion 156. The first cylindrical portion 152 is designed to fit within cylindrical bore 110 of the tool head 104. A slot 158 and pair of apertures 160, 162 are formed in the first cylindrical 152 portion to connect to a linkage (not shown). The linkage reciprocates and drives the knife within the bore 110. The second cylindrical portion 154 has a larger diameter than the first cylindrical portion and the outer surface 164 abuts against the surface of bore 110. (See, FIGS. 15-17.)

As can be seen in FIGS. 1-4, a knife edge 170 is formed by the convergence of four surfaces disposed at different angles relative to each other, a generally vertical surface 172 (as illustrated in FIGS. 2, 3) and first, second and third base surfaces 174, 176, 178, respectively. The knife-edge 170 has a central portion 180 and two outer portions 182, 184 which angle up and away from the central portion as best shown in FIG. 2. The middle base surface 176 in the preferred embodiment is positioned at approximately a 10-degree angle relative to the horizontal, as shown in FIG. 3. In the same preferred embodiment, the lateral base surface portions 174 and 178 are also formed at a 10-degree angle as shown in FIG. 2. As best illustrated in FIGS. 3 and 5, the angled surfaces 174, 176 and 178 of one embodiment of the present invention form a tapered base 188 of the knife body (FIG. 3) compared to a flat base 190 of a prior art knife body (FIG. 5). Thus, during operation, less area of the knife base surface initially contacts the band. Thus, the applied force is more efficiently apportioned to piercing the band with a knife-edge rather than tearing the band as is accomplished by the prior art knife body where the entire base surface area engages the band. This also allows a portion of the force to be directed to the continued movement of the punch and formation of the locking dimple. In addition, the angle of the base surfaces accommodates rotation of the tool as it tensions the free end of the band. During formation of the locking dimple, the tool tends to rotate about the buckle. Angling the base surfaces eliminates interference between the base surfaces and the operation of the tool. Angling the knife body will also orient the punch at an angle relative to the overlapping band portions. In the typical case, the punch is generally oriented perpendicular to the overlapping band.

Additionally, the prior art knife-edge 48 is a straight edge compared to the knife-edge 170 of the preferred embodiment of the present invention. The prior art straight edge 48 is positioned to engage and cut the entire width of the band simultaneously. Cutting the entire width of the band also requires additional force. By tapering the knife edge or otherwise altering its profile so that the knife edge does not contact the entire width of the band simultaneously, as taught by the present invention, the force used to cut the band can be spread out over time, leaving a portion of the overall force available, instead, to form the locking dimple.

As shown in FIGS. 1-4, the knife 102 further includes a cylindrical bore 186. The cylindrical bore 186 is sized to receive and hold the punch 100. As shown in FIGS. 8, 9, the punch 100 includes an upper cylindrical body portion 192, a recessed perimeter portion 194 having a curved surface, a middle cylindrical body portion 196 and a tip 198. The punch tip 198 includes a cylindrical body portion 200 and a generally hemispherical end portion 202. If the end portion 202 is too pointed, the walls of the locking dimple will be thinned and susceptible to shearing or collapse. If the end portion 202 is too rounded, the locking dimple may have spherical walls rather than cylindrical walls. The punch 100 is secured in the knife 102 by a pin 204 that extends through an aperture 206 in the second cylindrical body portion 154 of the knife and abuts the recessed portion 196 of the punch.

Figure 15:
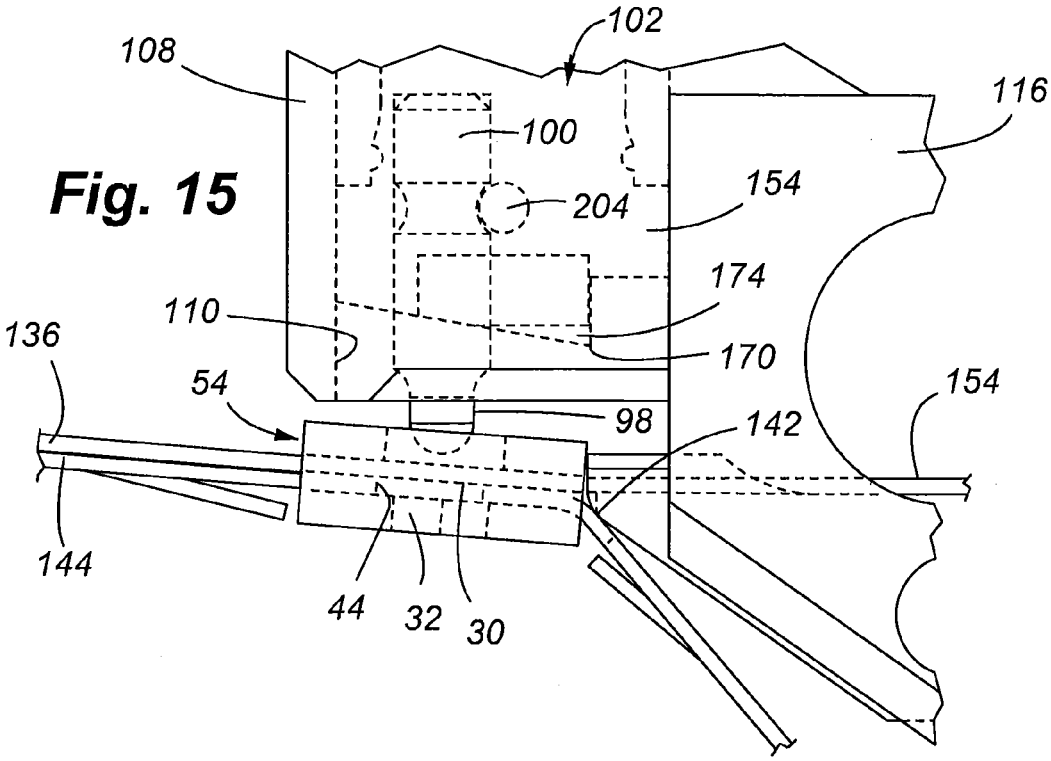
FIG. 15 is a partial side elevation view of a band clamp and locking tool containing one embodiment of a knife body and punch of the present invention, prior to locking the band clamp.

The operation of the preferred embodiment of the present invention will now be described with respect to FIGS. 15-24. More specifically, FIGS. 15-17 generally show the sequential operation of the apparatus of the present invention. In FIG. 15, the free end 154 of the band 136 is securely held in a tensioning apparatus (not shown) with the leading edge 142 of the cutter blade 118 abutting the buckle 12. The band encircles one or more objects to be bundled (not shown), with the free end 134 overlapping the secured end 144 of the band as it passes through the buckle 12 and is engaged by the tensioning apparatus. Thus, the band overlaps itself within the interior space 54 defined by the buckle. The punch tip 198 overlies the opening 28 in the buckle top 24 and the overlapping bands. As shown in FIG. 15, the punch tip 198 is positioned slightly inside the opening 28 but has not yet engaged the band. Similarly, the knife-edge 170 is positioned above the free end 134 of the band. Also, the load dimple 18 is laterally spaced a slight distance from the buckle 12. At some point prior to the punch tip 198 engaging the band, the tensioning apparatus will remove that gap.

Figure 16:
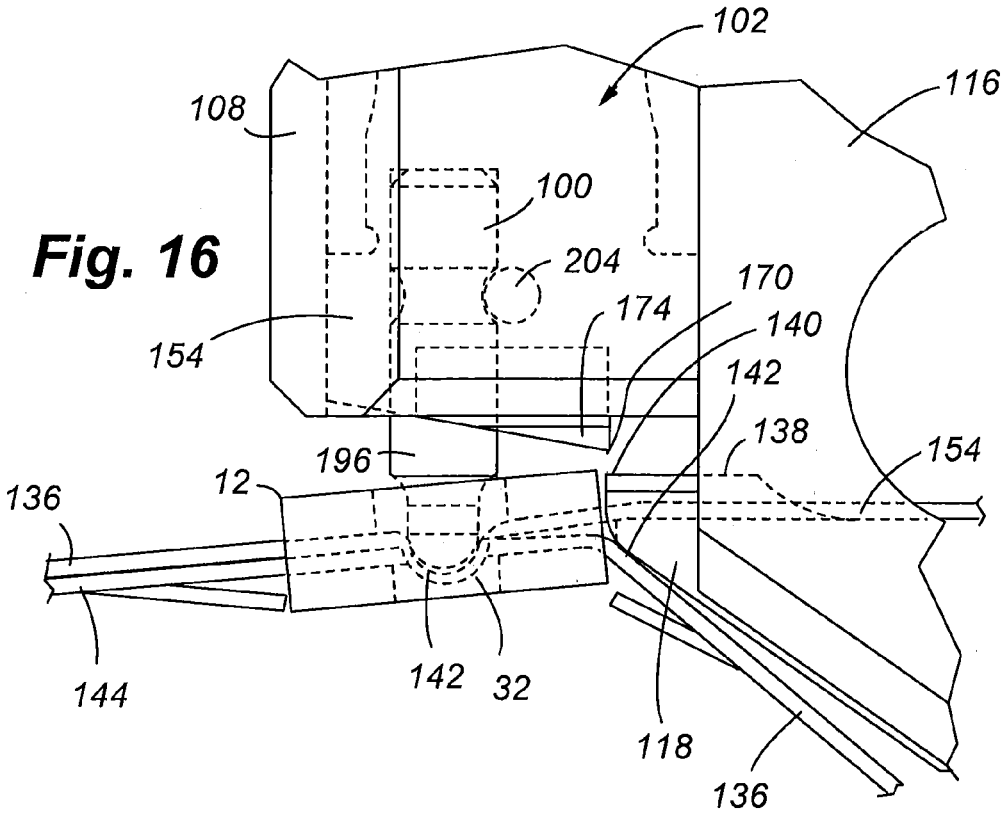
FIG. 16 is a partial side elevation view of a band clamp and locking tool of FIG. 15, showing the punch partially forming a locking dimple.

In FIG. 16, the knife 102 has moved from its most remote position toward the buckle 12 and overlapping band. The gap between the loading dimple 18 and the buckle has been removed. The punch tip 196 has been forced into the overlapping bands, causing them to partially form a locking dimple 42. The locking dimple itself is pressed through the aperture 30 in the band and into the opening 32 in the bottom 22 of the buckle. As is also shown, in this embodiment the downward force of the punch 100 causes the buckle to pivot counterclockwise relative to the leading edge 142 of the cutter blade such that the punch 100 is driven toward the trailing portion 60 of the interior surface 44 of aperture 30. The angled movement of the punch relative to the band removes some or all of the gap $\Delta x_1$ created when the locking dimple is formed at a position spaced from trailing edge 60.

As previously noted, the knife-edge 170 has a multi-dimensional profile or shape. Prior to engagement of the band by the knife-edge 170, the entire downward force of the knife 102 is applied to creating the locking dimple by deformation of the overlapping bands by the punch 100. As the knife moves further, the knife-edge 170 engages the free end 134 of the band. The motion occurs over a first period of time and a first length of travel. In the preferred embodiment, engagement will initially occur at the central portion 180 of the knife-edge 170. This will occur at the center of the band, rather than across the entire width of the band as occurs with knife-edge 48 of the prior art knife. As a result, a portion of the force used to drive the knife 102 toward the band and to drive the punch tip 196 into the band will now be applied to initiating the cutting of a portion of the band. This motion occurs over a second period of time and a second length of travel. As the knife proceeds further in its movement, the two lateral sloping knife edges 182, 184 will progressively engage the free end of the band, causing further cutting of the band and utilizing an increasing amount of the force applied to the action of the knife. This motion occurs over a third period of time and a third length of travel. However, as compared to straight knife-edge 48, the profile of knife-edge 170 requires the knife 102 to travel a further distance to completely cut the band. A result of this additional travel is that the punch tip 196 also travels further into the overlapping bands and forms a deeper and more complete or more fully formed locking dimple 42. This also causes the locking dimple 42 to be formed more closely adjacent the edge portion 60 of the inside surface 44 of the aperture 30.

Figure 17:
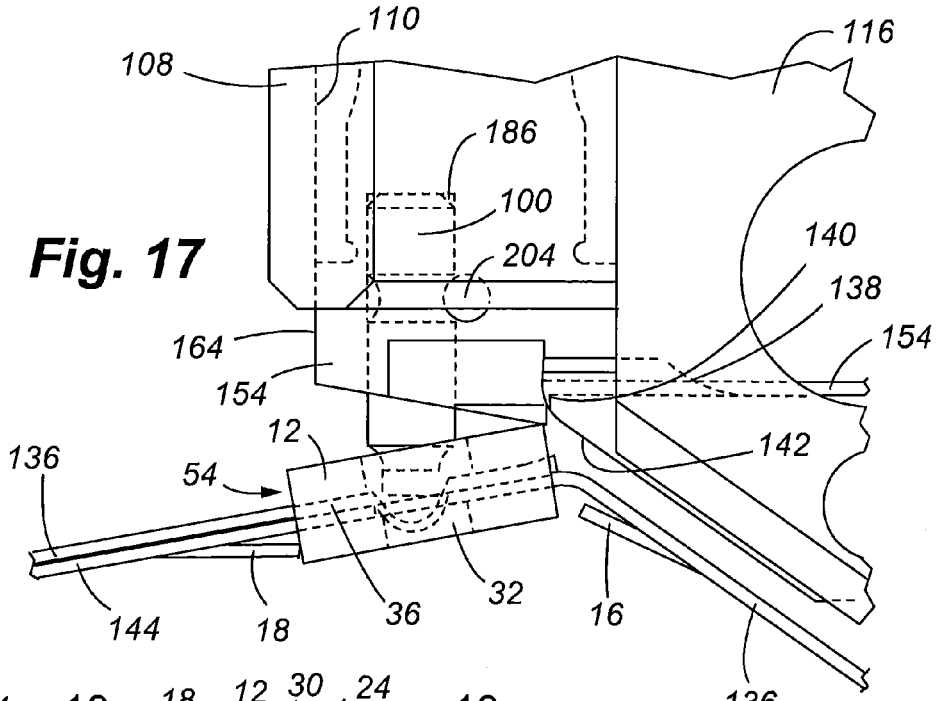
FIG. 17 is a partial side elevation view of the band clamp and locking tool of FIG. 15, following formation of the locking dimple and cutting of the free end of the band.
Figure 18:
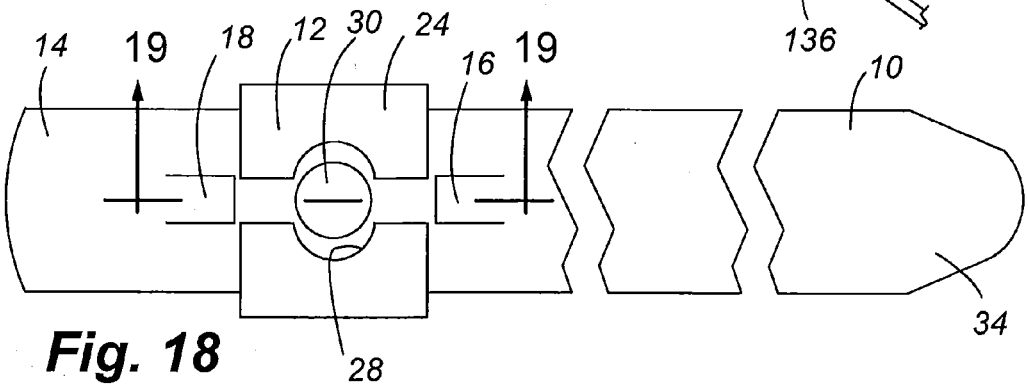
Fig. 18 Prior Art
FIG. 18 is a top plan view of a prior art band clamp comprising a band and buckle.
Figure 19:
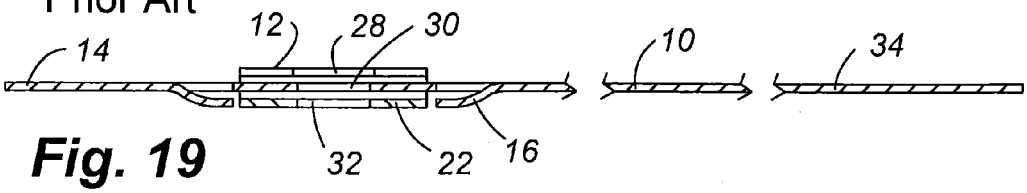
Fig. 19 Prior Art
FIG. 19 is a cross section of the band clamp of FIG. 18 taken along line 19-19 of FIG. 18.
Figure 20:
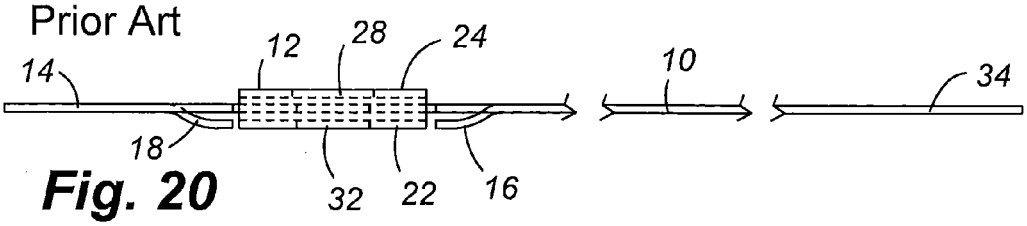
Fig. 20 Prior Art
FIG. 20 is a side elevation view of the band clamp of FIG. 19.
Figure 24:
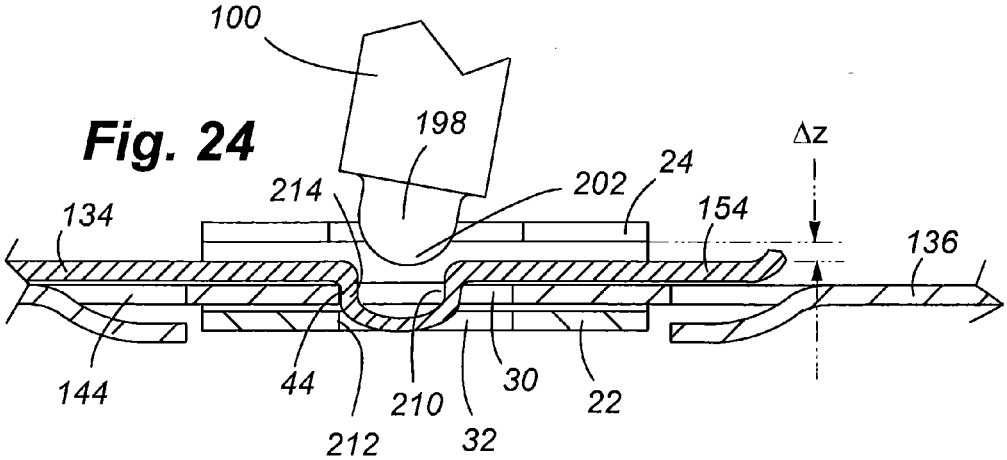
FIG. 24 is a partial side elevation of a locked band clamp formed according to one embodiment of the present invention.

Ultimately, as shown in FIG. 17, the knife-edge 170 progresses past the cutting edge 140 of the cutter blade 118, fully cutting the free end of the band. At this point, the locking dimple 42 will be fully formed and the tool head has disengaged the band clamp. This arrangement is generally shown in FIG. 24, where a fully and properly formed locking dimple 42 is shown. The locking dimple 42 includes a substantially cylindrical deformation formed in the overlapping portion of the band that extends through the opening 30 in the underlying portion of the band. As a result, a wall 210 is created that is generally parallel to the inner surface 44 of the opening 30 in the band and the inner surface 212 of the opening 32 formed in the base of the buckle. It should be appreciated that the entire circumference or periphery of the wall 210 need not be parallel to the inside surface 44 of the entire aperture 30. Rather, that portion or surface 214 of the wall 210 that abuts the inside surface 44 when a load is applied is most relevant. The portion of the wall 210 that does not abut the inside surface 44 need not be parallel to the inside surface 44. Because of the tensioning of the band by the tool, the buckle 12 will have been forced against the load dimple 18 and little or no slack will be present during formation of the locking dimple 42.

Alternative knife-edge profiles are shown in FIGS. 29, 30 and 34. In FIGS. 29 and 30, the knife-edges 170 are convex and concave, respectively. FIGS. 34A-34L show further knife-edge profiles within the scope of the present invention. It should be appreciated that the knife-edge portions do not need to be linear as is shown in the embodiment of FIG. 2. Rather, all or some of the knife-edge may be curved, linear or a combination of both. The object is to create the desired force profile as a function of travel of the knife body and punch.

An alternative punch design is shown in FIG. 31. This punch does not have a rounded tip, but comprises a leading edge comprising a rectangular base portion 240, with two beveled side walls 242 and a generally cylindrical body 244. This punch will also form a locking dimple with a side wall portion 214 that is substantially parallel to the inside surface 44 of the aperture 30. It should be appreciated that other punch designs that achieve this result, without compromising the integrity of the locking dimple due to thin walls, are also within the scope of this invention.

Figure 21:
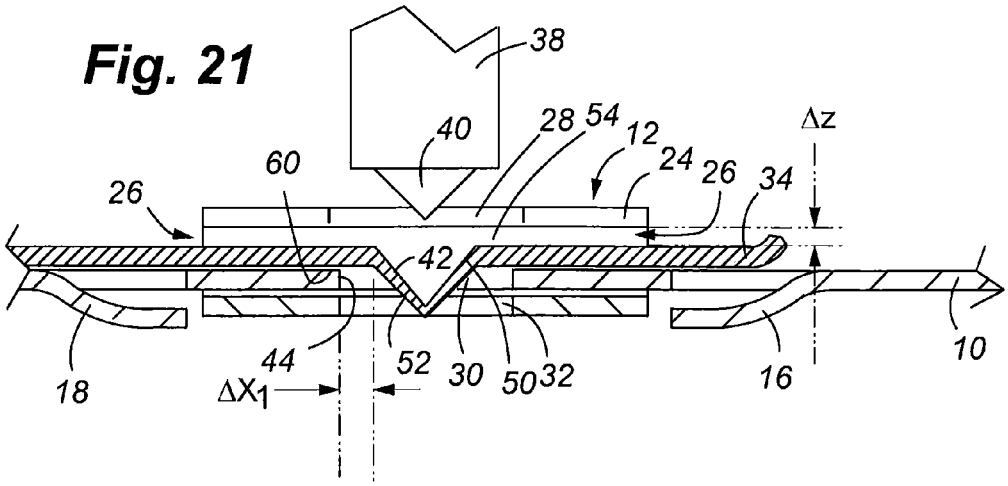
FIG. 21 is a partial cross-section view of a prior art band clamp after being locked.
Figure 22:
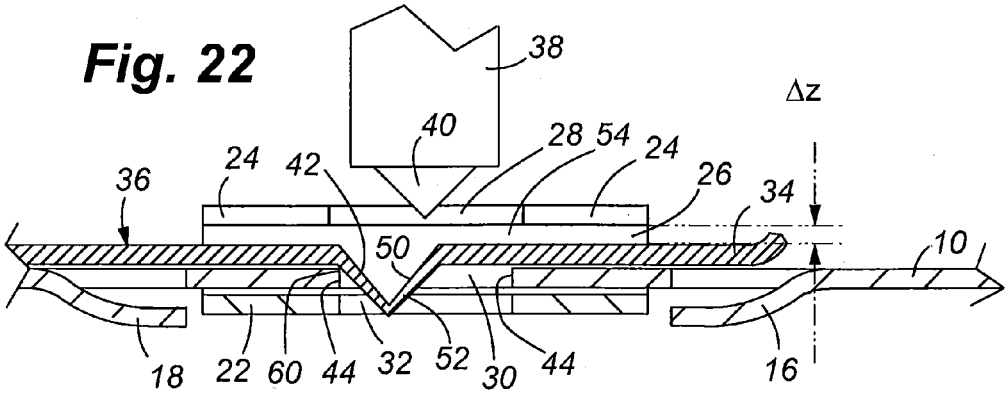
FIG. 22 is a partial cross-section view of a band clamp after being locked and experiencing slip-back.
Figure 23:
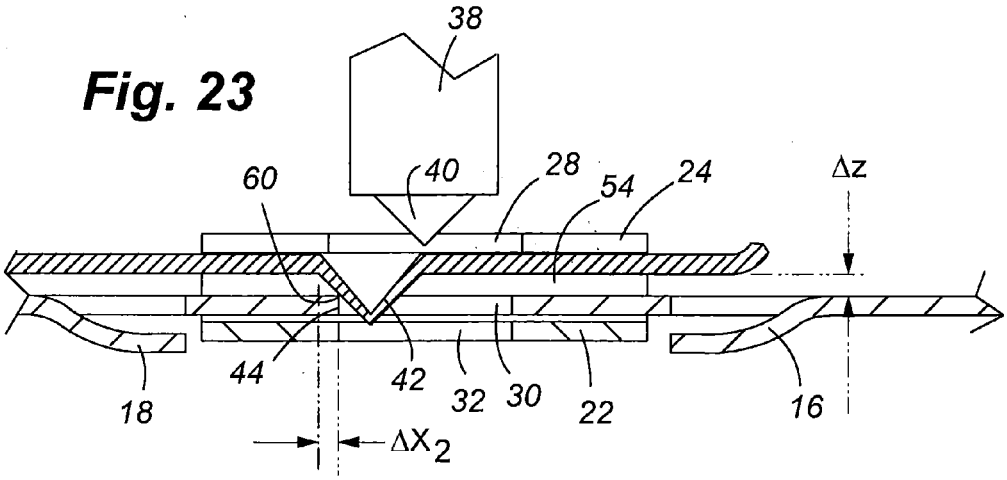
FIG. 23 is a partial cross-section view of a prior art band clamp after being locked and experiencing additional slip-back.

Some of the advantages of the present invention can be seen by comparing FIGS. 21-24. In FIGS. 21-23, a locking buckle formed by a conventional pointed punch tip 40 is shown. A pointed or conical punch tool forms a conical locking buckle 42. In addition, the cold formation causes a thinning of the metal during the deformation stage. This is referenced at 52. The gap $\Delta x_1$ between the wall 50 of the locking dimple 42 and the inner wall 44 of the aperture 30 formed in the lower portion of the band defines a distance that the band can expand following creation of the locking dimple 42 and cutting of the free end of the band. FIG. 21 represents the position of the locking dimple 42 at the moment the tool applies the clamping force and cuts the free end 34 of the band. At that moment in time, the gap $\Delta x_1$ is likely present. Subsequently, the band expands by the distance $\Delta x_1$, as shown in FIG. 22. The wall 50 has moved into engagement with surface 44. That lateral movement or expansion of the band relative to itself, also referred to as slip back, reduces the retained force initially created by the clamping tool. Typically, the end user desires a retained force of a particular quantified amount. A tension is applied to the band to create a clamping force on the band. Post-locking slippage of the band relative to itself necessarily lowers the clamping force that was initially achieved by the clamping tool. The amount of slip back determines the retained tensile force. Conversely, if a particular retained force is desired, a greater clamping force must be applied to account for the slip back. However, there are limits that apply when generating the clamping force, including but not limited to deforming the objects being clamped or breaking the band due to an excessive force being applied.

Moreover, because of tolerances in the manufacture of the band and buckle, there is also an ability for the band to move vertically within the interior space 54 defined by the buckle. This is shown by the dimension $\Delta z$ in FIGS. 21-24. The space 54 permits two layers of the band to pass, but also includes additional height ($\Delta z$). Thus the band and buckle can be moved vertically relative to each other, as shown in these figures. Because the locking dimple has a conical shape, any ability of the upper portion of the band to move vertically with respect to the lower portion of the band causes the wall 50 of the locking dimple to act as a ramp. The sloped wall 50 rides against the edge 60 of the inner surface 44 of the inner surface 44 of the aperture 30 of the lower portion of the band. This in turn creates further lateral slippage of the upper portion of the band relative to the lower portion of the band, as is shown by $\Delta x_2$ in FIG. 23. Thus, in the prior art band clamp it is possible for the band to slip back a total distance of $\Delta x_1+\Delta x_2$ However, even if the locking dimple 42 were formed adjacent the inner surface 44 of the aperture 30, as shown in FIG. 22, the band will still likely expand by the distance $\Delta x_2$.

Also, the extent of lateral slippage may cause the thinned portion 52 of the locking dimple to abut the edge 60 of the aperture 30 of the lower portion of the band. If sufficient tension force has been placed on the band, the locking dimple may shear and/or crumple, causing the band to completely release.

In comparison to FIG. 24, illustrating the preferred embodiment of the present invention, the locking dimple 42 has a generally cylindrically shaped wall 210. This creates a wall 210 of the locking dimple that is generally parallel (or certainly more parallel than a ramped surface) to the inner surface 44 of opening 30 and the inner surface 212 of opening 32. The ramped wall of the prior art locking depth has been substantially eliminated. Therefore, any relative vertical movement ($\Delta z$) between the overlapping bands will not cause as much, if any, lateral slippage of the band relative to itself or will substantially reduce the amount of slippage compared to the prior art design. It should be appreciated that a substantially cylindrical shaped wall is only one embodiment of the improved locking dimple. Other shaped punches will achieve similar results, provided a uniformly thick wall is formed in the locking dimple that is parallel to the surface of the wall of the aperture where abutment occurs.

In addition, one embodiment of the tool of the present invention is designed to form the locking dimple in a manner that abuts or is closely adjacent to the trailing edge 60 or load-bearing surface 44 of the aperture 30 in the underlying portion of the band. Placement of the locking dimple in this manner, rather than at the center or opposite edge of the aperture 30, eliminates or substantially reduces slippage formed in the lateral direction ($\Delta x_1$). Further still, the hemispherical shape of the punch tip 196 of the preferred embodiment does not thin out the walls 210 of the locking dimple to the same extent as does the conical punch tip 40. Thus, the locking dimple formed by this embodiment is less susceptible to shearing or crumpling. Accordingly, the retained force initially applied by the tool on the objects to be bundled is generally preserved and not substantially reduced as is the case with prior art devices.

Figure 25:
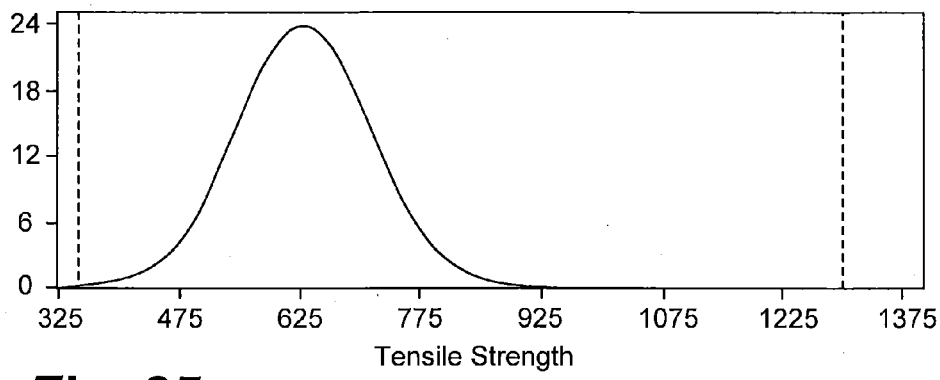
FIG. 25 is a graph showing the standard deviation of the tensile strength for a prior art ⅜" band clamp of the type shown in FIG. 21.
Figure 26:
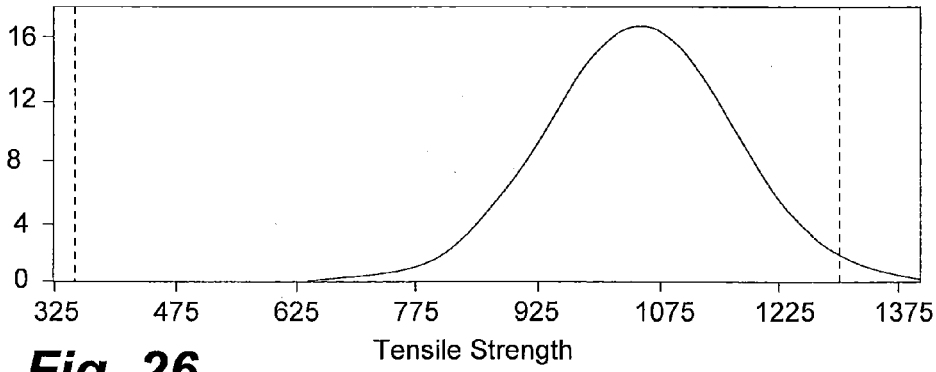
FIG. 26 is a graph showing the standard deviation of the tensile strength for a band clamp formed according to the embodiment of the present invention shown in FIGS. 15-17.

FIGS. 25-26 are a pair of graphs showing the standard deviation of the tensile force of a locked prior art ⅜-inch band clamp of the type shown in FIG. 21 and a ⅜-inch band clamp of the type shown in FIG. 24, respectively. As is illustrated, by using the preferred embodiment of the present invention, the tensile force of a ⅜-inch band is unexpectedly increased by approximately 60 percent, from approximately 680 pounds to 1,100 pounds. An increased tensile force would be similarly available with any size band, although the percentage improvement may vary. Nonetheless, those skilled in the art will conclude that a ten percent (10%) improvement is significant and falls within the scope of the present invention, as it represents an order of magnitude improvement over existing ties.

The unexpected benefits of the present invention may be normalized to ties of different dimensions. The table of values shown in FIG. 35 is based upon a ⅜-inch tie. Nonetheless, the unexpected benefits of the present invention, for ties of different dimensions, can be seen from comparing certain ratios utilizing this data. As identified in the table, loop tensile strength (Its) is the amount of load required to pull apart two halves of a split circulate mandrel after a clamp has been applied around it. Equivalent load in the band is calculated by multiplying loop tensile strength by 0.48 to account for friction. Load in band at yield (Ly) is the load in the band at the time yielding as the band begins to occur. Yield is a plastic or permanent deformation in the band material. Material that has yielded does not return to its original shape when the load is removed. Load in the band at ultimate strength (Lu) is the load in the band at the moment the band breaks. Ultimate strength is the maximum load carried by a band at the moment it breaks.

Using these definitions, various ratios illustrate the unexpected benefits of the present invention. For example, the ratio between the force carried by the lock at the time of failure (Lf) and the load that would be carried by the band at its ultimate strength (Lu) for the ⅜-inch tie is 480/863 or 0.556. The ratio of the force carried by the lock at the time of failure (Lf) and the load carried by the band at its yield strength (Ly) is 480/450 or 1.0667. A third useful ratio is the load that would be carried by the lock at the time of failure (Lf) and the area of the band 480/0.0075 or 64,000. Other ratios evidencing the benefits of the present invention may be known to those of skill in the art and are deemed to be within the scope of the present invention, although not literally set out herein. Comparing these three ratios to the same ratio for a standard ⅜-inch tie shows an approximately sixty-seven percent (67%) improvement obtained by the present invention. Additionally, it should be appreciated that improvements of a lesser amount are also within the scope of the present invention. Indeed, while the preferred embodiment exhibits a sixty-seven percent (67%) improvement, it is recognized that the present invention can be implemented to a lesser extent and still be effective and offer a relatively substantial improvement over prior art. It is believed that even a five percent (5%) improvement compared to the prior art is significant.

Figure 27:
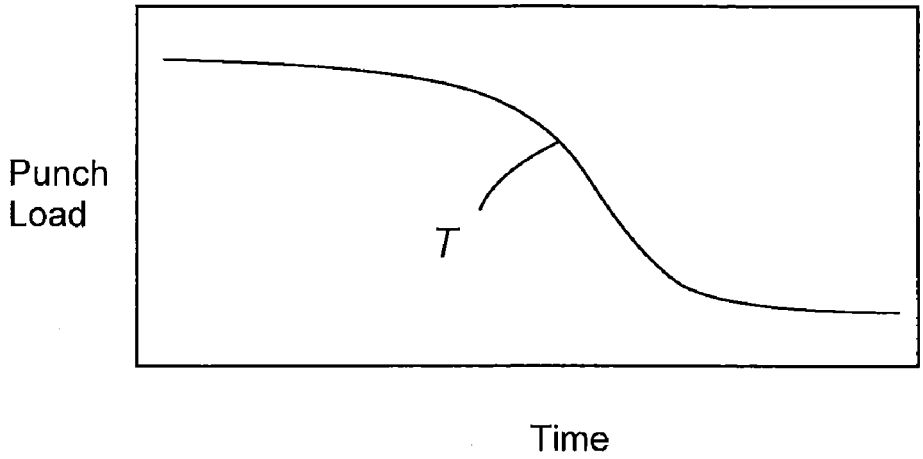
FIG. 27 is a graph representing the punch load applied by a tool of the preferred embodiment of the present invention over time.
Figure 28:
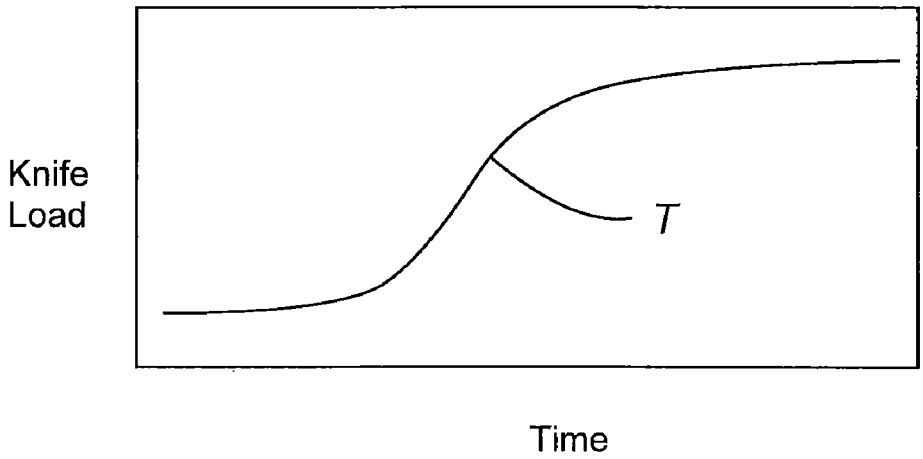
FIG. 28 is a graph representing the knife load applied by a tool of the preferred embodiment of the present invention over time.
Figure 34A:
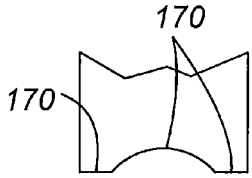
FIGS. 34A-34L are various alternative embodiments of knife-edge profiles of the present invention.
Figure 34B:
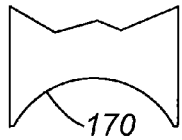
Figure 34C:
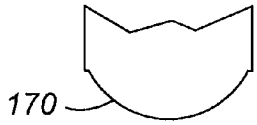
Figure 34D:
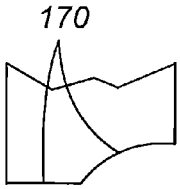
Figure 34E:
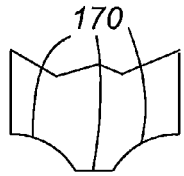
Figure 34F:
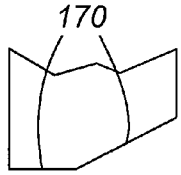
Figure 34G:
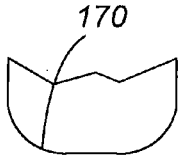
Figure 34H:
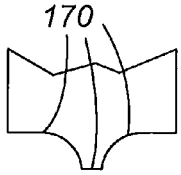
Figure 34I:
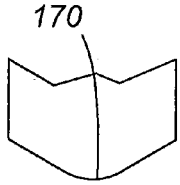
Figure 34J:
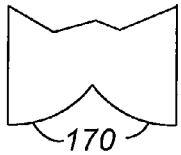
Figure 34K:
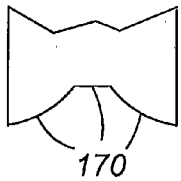
Figure 34L:
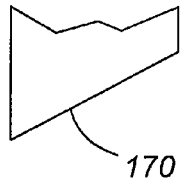

FIGS. 27-28 illustrate the concept of optimizing the application of force over time as is afforded by the preferred embodiment of the present invention. FIG. 27 generally illustrates the punch load force applied over time and FIG. 28 generally illustrates the knife load force applied over time. As can be seen, a greater force is initially applied to forming the locking dimple than is applied to the knife because the punch will engage the band prior to the knife. Then a shift in applied force occurs when the knife-edge initiates cutting of the band. However, because only a portion of the band is being cut, as opposed to the entire band, the applied force can still be divided between the punch and the knife. During this transfer phase T (as shown in the figures), the punch dwells for a time within the locking dimple to cause a yield in the material and reduce the spring back characteristics of the deformed metal area, thereby facilitating maintaining the desired shape of the locking dimple. Completing of the cutting action includes applying further force to the punch to complete formation of the locking dimple. The profile of the knife-edge determines the force over time profile.

Additionally, in an alternative embodiment, the side wall 210 of the locking dimple need not be parallel to the aperture side wall 44. Rather, the two surfaces may be formed at an angle relative to each other, provided the relative angle inhibits slip back, rather than promoting slip back as in the case of the embodiments of FIGS. 21-23. FIG. 32 illustrates this point. Line 246 is a reference line drawn parallel to the abutting surface 44 of aperture 30. FIG. 32 shows a locking dimple 42 whose base 248 is larger or wider than the opening 250. The abutting side wall 252 of the locking dimple is formed at a positive slope relative to the reference line, as "positive" is defined in FIG. 32. In contrast, a "negative" slope as defined in FIG. 32 would be the prior art embodiment of FIGS. 21-23. Given the outward force exerted in the locked band by the clamped object(s), the band will try to separate and forces will be placed upon the abutting surfaces of the locking dimple side wall and aperture side wall. A locking dimple side wall that is parallel or at a positive slope or angle compared to the aperture side wall surface where abutment occurs will inhibit slip back. A negative slope or angle to the locking dimple side wall will facilitate slip back. There is no restriction or limit on the degree of the positive angle, as long as the locking dimple side wall is drawn with a uniform thickness. Still further, the locking dimple 42 could be formed with a toe portion 260 that extends outwardly to restrict relative movement of the overlapping band layers and locking dimple, and to counteract any rotational movement of the locking dimple relative to the side wall of the aperture. An example of this is illustrated in FIG. 33.

FIG. 36 generally illustrates the forces of the overall stages of the clamping process. The lower plot 220 represents mean the value of forces for a standard ⅜ inch tie assembly and the upper plot 222 represents the mean value forces for a tie assembly of one embodiment of the present invention. The plot 222 was generated from a band that optimized loop tensile strength. Other parameters, such as retained tensile force, were not fully optimized for this test. Higher values could be achieved. The data was generated in each instance using a 16-inch mandrel, 75 pounds per square inch (psi) tension and 100-psi cutoff. As illustrated at $C_f$, approximately the same clamping force was applied to each tie, 462 pounds for the standard band, plot 220, and 520 pounds for the band made according to the present invention. Even though it is not optimized, the retained force $R_f$ for plot 222 exceeds that of plot 220 (293 pounds compared to 236 pounds), an approximate 20 percent increase. However, the loop tensile strength Its for plot 222 is 1,034 pounds, compared to 544 pounds for plot 200, an approximate 90 percent increase using the same band, but forming an improve locking dimple according to the present invention.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A tool for locking a band clamp, the band clamp comprising an elongate band having a first end and a second end, a buckle disposed on the band proximate the second end and having an open interior to receive the first end of the band such that the first end of the band overlaps the second end of the band, the tool comprising:

a. A tool head;

b. a knife body disposed in said tool head and moveable between a first and second position, the knife body having a first end disposed in said tool head and a second end that extends from said tool head and engages the band as the knife body moves from the first position to the second position, the second end having a base portion with multiple surfaces that form a knife edge;

c. a punch having a first end and a second end, said first end secured to said knife body and said second end extending from said knife body a greater distance than said knife edge such that the second end of the punch contacts the band before the knife edge as the knife body moves from the first position to the second position, said second end of said punch comprising a substantially hemispherical portion and a substantially cylindrical portion.

2. The tool of claim 1, wherein said knife edge further comprises a plurality of cuffing edges.

3. The tool of claim 2, wherein said knife edge comprises three edges.

4. The tool of claim 3, wherein said three edges are nonlinear.

5. The tool of claim 4, wherein said three edges comprise a central edge and two lateral edges, and said lateral edges are formed at an angle relative to said center edge.

6. The tool of claim 5, wherein said lateral edges are disposed at a ten degree angle relative to said center edge.

7. The tool of claim 2, wherein one of said multiple cutting edges engages the band prior to the other of said multiple cutting edges as said knife body moves from said first position to said second position.

8. The tool of claim 1, wherein said knife body comprises four surfaces that join to form said knife edge.

9. The tool of claim 8 wherein none of the four surfaces are coplanar to any of the other three surfaces.

10. The tool of claim 1, wherein said second end of said punch forms a locking dimple in said first end of said band, said locking dimple having a cylindrical wall portion.

11. The tool of claim 1, wherein the second end of the band positioned within the open interior of the buckle includes an aperture and said second end of said punch forms a locking dimple in the first end of the band that extends into the aperture and the locking dimple includes a wall portion that is substantially parallel to the walls forming the aperture in the second end of the band.

12. A tool for locking a band clamp, the band clamp comprising an elongate band have a first end and a second end, a buckle disposed on the band proximate the second end and having an open interior to receive the first end of the band such that the first end of the band overlaps the second end of the band, the tool comprising:

a. A tensioning mechanism for applying tension to the first end of the band after it has passed through the buckle;

b. a first tool surface that abuts the buckle when the first end of the band is under tension;

c. a reciprocating member that moves between a first position and a second position, said reciprocating member disposed above the buckle and overlapping bands, such that when said reciprocating member is in said first position the first end of the band may be grasped by the tensioning mechanism and when said reciprocating member is in said second position a portion of the first end of the band is severed from the band at a position adjacent the buckle; and d. a punch secured to said reciprocating member, said punch having a hemispherical tip, whereby when said reciprocating member moves from the first position to the second position said punch tip forms a locking dimple in a portion of the first end of the band that overlaps the second end of the band.

13. The tool of claim 12, wherein said reciprocating member comprises knife edge means for cutting a portion of the first end of the band as the reciprocating member moves from said first position to said second position.

14. The tool of claim 13, wherein said knife edge means determines the shape of the locking dimple.

15. In a tool for forming a locking dimple in an overlapping portion of a band, the tool having a reciprocating knife body that moves between a first position above the overlapping band portion and a second position in which the free end of the band is cut and fully removed from the band, the improvement comprising: a knife edge disposed on the knife body at an angle relative to the overlapping band portion, the knife edge comprising multiple knife edges disposed on said knife body to cut the free end of the band and said multiple knife edges are disposed relative to each other such that a first knife edge engages the band sequentially followed by a second knife edge.

16. The tool of claim 15, further comprising a third knife edge disposed on said knife body and positioned relative to said first and second knife edges such that said third knife edge engages the band simultaneously with said second knife edge.

17. The tool of claim 16, wherein said second and third knife edges are disposed at an angle relative to said overlapping band.

18. A method of increasing the long tensile strength of a band clamp after it is locked around one or more objects, comprising:

a. Providing a band clamp having a first end and a second end and a buckle positioned on said band adjacent said second end, the band further having an aperture formed proximate the second end and within a space defined by the buckle, the aperture having an interior surface;

b. overlapping the second end of the band and the aperture with the first end of the band; and c. forming a locking dimple extending into the aperture, said locking dimple having an exterior wall portion that is substantially parallel to the interior surface of said aperture.

19. The method of claim 18, wherein the step of forming a locking dimple comprises driving a punch into said second end of said band.

20. The method of claim 19, further comprising driving the punch into the second end of said band, where the punch is positioned at an angle relative to the band.

21. The method of claim 19, wherein said punch comprises a punch tip having a substantially hemispherical shaped portion and a substantially cylindrical shaped portion and said exterior wall portion of the locking dimple is formed at least in part by said substantially cylindrical shaped portion.

22. The method of claim 18, wherein forming a locking dimple comprises driving a punch into said second end of said band, said punch including dimple forming means for forming the walls of the locking dimple that are substantially uniform in thickness.

23. The method of claim 18, further comprising positioning a knife body above said buckle and overlapping band, said knife body comprising a knife having multiple edges and moving said knife body from a first position to a second position whereby said multiple edges fully cut a portion of the second end of the band from the remaining portion of the band.

24. The method of claim 23, wherein said locking means comprises a rounded punch tip.

25. The method of claim 18, wherein said multiple knife edges are all coplanar and not collinear.

26. A locked band formed by the method of claim 18.

27. The method of claim 18, further comprising forming a locked band having a ratio of the force carried by the lock at the time of failure to the load at its ultimate band strength is at least 0.37.

28. A method of improving the loop strength of a band clamp, measured after the band clamp is locked around one or more objects, comprising:

a. Providing a band clamp having a first end and a second end and a buckle positioned on said band adjacent said second end, the band further having an aperture formed proximate the second end, and the aperture having an interior surface;

b. positioning the band about one or more objects and inserting the first end of the band through the buckle to create an overlapping band portion with the first end of the band overlapping the aperture formed proximate the second end of the band and extending out of the buckle;

c. providing a reciprocating knife body having a knife for removing an excess portion of the first end of the band, the knife comprising multiple knife edges;

d. providing a punch connected to said knife body;

e. moving the knife body from a first position to a second position and causing said punch to form a portion of a locking dimple in said first end of said band;

f. moving the knife body from a second position to a third position to engage a first of said multiple knife edges with the first end of the band and to cut a portion of the band;

g. moving the knife body from a third position to a fourth position to engage at least a second of said multiple knife edges with the first end of the band and to cut a further portion of the band; and h. continuing to form a complete locking dimple as said knife body moves from said second position to said fourth position.

29. The method of claim 28, further comprising driving said punch into the overlapping band portion at an angle less than ninety degrees.

30. The method of claim 28, further comprising cutting the first end of the band from the center of the band outwardly toward the lateral edges of the band.

31. A method for forming a locking dimple in a band clamp, the band clamp comprising an elongate band having a first end and a second end and having a first surface and a second surface spaced from and parallel to the first surface, the lateral edges of the first and second surfaces defining the width of the band, and a buckle disposed proximate the second end, the method comprising:

a. Passing the first end of the band through the buckle to from an overlapping band portion comprising an upper band segment and a lower band segment, the lower band segment including an aperture;

b. forcing a dimple forming member into the upper band segment to form a locking dimple from said upper segment in said aperture disposed in the lower band segment;

c. cutting a portion of the width of the first end of the band with a first knife edge; and d. following cutting a portion of the width of the first end of the band with a first knife edge, progressively cutting the remaining width of the first end of the band with at least a second knife edge.

32. The method of claim 31, wherein forcing a dimple forming member into the upper band segment to form a locking dimple begins prior to cutting a portion of the width of the first end of the band with a first knife edge and continues through cutting the remaining width of the band with at least a second knife edge.

33. The method of claim 31, wherein progressively cutting the remaining width of the first end of the band with at least a second knife edge comprises using a second and third knife edge simultaneously.

34. The method of claim 31, wherein cutting a portion of the width of the first end of the band with a first knife edge comprises cutting the band at the center of the width of the band.

35. The method of claim 34, wherein progressively cutting the remaining width of the first end of the band with at least a second knife edge comprises cutting the band outwardly toward its lateral edges.

36. The method of claim 31, wherein forcing a dimple forming member into the upper band segment occurs during a first period of time.

37. The method of claim 36, wherein cuffing a portion of the width of the first end of the band with a first knife edge occurs during at least a second period of time.

38. The method of claim 37, wherein progressively cutting the remaining width of the first end of the band with at least a second knife edge occurs during a third period of time.

39. The method of claim 38, further comprising simultaneously continuing to force the dimple forming member into the upper band segment during the second period of time.

40. The method of claim 39, further comprising simultaneously continuing to force the dimple forming member into the upper band segment during the third period of time.

* * * * *

UNITED STATES PATENT AND TRADEMARK OFFICE

CERTIFICATE OF CORRECTION

PATENT NO. : 7,650,680 B2
APPLICATION NO. : 11/253101
DATED : January 26, 2010
INVENTOR(S) : Stillings et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 858 days.

Signed and Sealed this

Twenty-third Day of November, 2010

David J. Kappos

David J. Kappos
*Director of the United States Patent and Trademark Office*